US006494235B1

(12) United States Patent
Bruyere et al.

(10) Patent No.: US 6,494,235 B1
(45) Date of Patent: Dec. 17, 2002

(54) BIAS-BOUND FABRIC, METHOD FOR MAKING SAME AND WEAVING MACHINE FOR CONTINUOUSLY MAKING SUCH A FABRIC

(75) Inventors: Alain Bruyere, Villefontaine (FR); Christian Debaille, Sathonay Village (FR); Franck Perret, Lyons (FR)

(73) Assignee: Hexcel Fabrics (societe anonyme), Villeurbanne (FR)

( * ) Notice: Subject to any disclaimer, the term of this patent is extended or adjusted under 35 U.S.C. 154(b) by 0 days.

(21) Appl. No.: 09/936,908

(22) PCT Filed: Mar. 22, 2000

(86) PCT No.: PCT/FR00/00710

§ 371 (c)(1),
(2), (4) Date: Sep. 19, 2001

(87) PCT Pub. No.: WO00/56965

PCT Pub. Date: Sep. 28, 2000

(30) Foreign Application Priority Data

Mar. 22, 1999 (FR) ..... 99 03696

(51) Int. Cl.[7] ..... B32B 3/08
(52) U.S. Cl. ..... 139/11; 139/DIG. 1
(58) Field of Search ..... 139/11, DIG. 1

(56) References Cited

U.S. PATENT DOCUMENTS

| | | | | | |
|---|---|---|---|---|---|
| 1,201,257 | A | * | 10/1916 | Cobb | 139/DIG. 1 |
| 1,368,215 | A | | 2/1921 | Stewart | |
| 3,252,676 | A | * | 5/1966 | Frieder | 139/DIG. 1 |
| 4,887,656 | A | * | 12/1989 | Verbauwhede et al. | 139/DIG. 1 |
| 5,556,495 | A | * | 9/1996 | Ford et al. | 139/DIG. 1 |
| 5,706,867 | A | | 1/1998 | Liao | |
| 5,775,381 | A | * | 7/1998 | Addis | 139/DIG. 1 |

FOREIGN PATENT DOCUMENTS

| | | |
|---|---|---|
| DE | 3042569 | 5/1982 |
| WO | WO8901405 | 2/1989 |

* cited by examiner

*Primary Examiner*—John J. Calvert
*Assistant Examiner*—Robert H. Muromoto, Jr.
(74) *Attorney, Agent, or Firm*—Dennison, Schultz & Dougherty

(57) ABSTRACT

A bias fabric is provided in that it is in the form of a cloth of length (L) and of finite width (l), being constructed by interlaced yarns (2, 3) extending in respective directions (D and d) that are oblique relative to the length (L), and each of which presents no knotting. The invention is applicable to engineering fabrics based on flat yarns.

30 Claims, 9 Drawing Sheets

BIAS-BOUND FABRIC, METHOD FOR MAKING SAME AND WEAVING MACHINE FOR CONTINUOUSLY MAKING SUCH A FABRIC

BACKGROUND OF THE INVENTION

Technical Field

The present invention relates to the technical field of weaving, and more particularly it relates to the field of fabric intended for industrial use.

Although such a technical field appears to be the most preferable, it should be understood that the present invention can be implemented in other fields, and does not exclude furnishing fabrics or clothing fabrics, for example.

In the preferred field, it is known that the disposition of fibers in a fabric has great influence on the performance of the fabric both in terms of strength in one or more preferred directions, and of suitability for fitting closely over surface shape, particularly when such fabrics are used as reinforcement when making a composite material in association with a matrix, e.g. of resin.

Such abilities are recognized and sought out in order to obtain structural engineering parts of more or less complicated shape by means other than conventional machining, embossing, or stamping which are difficult, lengthy, and expensive to perform, and sometimes also difficult to carry out when the material that is to be used, although of suitable strength, constitutes an insurmountable obstacle because of its mass.

At present, the technique of manufacturing composite material parts is particularly suitable for making engineering parts of more or less complex shape that need to present both light weight and good strength.

Merely as an indication, this applies to hulls, floats, rocket fairings, shrouds for drive units, etc.

Once an attempt is made to comply with the constraints required by such a manufacturing technique, it is clear that optimizing structural characteristics necessarily involves ensuring that the reinforcement constituted by the fabric extends in the proper direction(s) so that the fibers can take up the stresses which will subsequently be imposed on the resulting part in or along the appropriate direction.

Similarly, it is necessary to be able to satisfy the requirement for fitting closely to the shape of the part that is to be obtained, which shape is generally represented by a positive or negative mold on or in which the composite material is to be placed so as to reproduce accurately the shape of the pattern.

SUMMARY OF THE INVENTION

This ability to fit closely to the shape of the pattern is generally referred to in the art as "drapability" or "layability", which is a quality that an engineering fabric must be capable of presenting in association with the preceding requirements.

All of these reasons mean that as a general rule attempts are made to use a fabric whose individual yarns are not interlaced or crossed in conventional manner whereby some of the yarns, generally referred to as "warp" yarns, extend lengthwise relative to the woven cloth while others, generally referred to as "weft" yarns, extend crosswise, i.e. across the width of said cloth.

In practice it is often desirable to be able to have fabrics in which individual yarns extend on the bias relative to the above two fundamental directions, with such bias, although generally ±45° bias, naturally being capable of being subjected to angular variations that facilitate angular spreading of one of the categories of yarns.

PRIOR ART

In order to satisfy such a requirement using traditional textile manufacturing techniques, proposals have been made to cut individual strips of fabric at an oblique orientation, e.g. at an angle of 45°, out from a piece of cloth woven in conventional manner. Each strip can then be referred to as a "bias" fabric suitable for being oriented in such a manner that some of its component yarns are placed parallel to certain stresses to which the final part will be subjected.

Such a method is penalizing in several ways.

Firstly, it is clear that the individual strips of bias fabric produced in this way are of finite length, at best equal to the diagonal of a square corresponding to the width of the woven cloth when the orientation used is ±45°. This gives rise to a large fraction of scrap which is very penalizing on the cost price of bias fabric, in particular if the fiber constituting the yarns is expensive to produce.

Another drawback comes from the fact that it is then necessary to place such cutout strips of bias fabric side by side in order to cover a large area, and more particularly a long length. If a uniform structure is to be obtained, the question which then arises is clearly that of making connections between adjacent edges, where such connections must be made in such a manner as to present the same laying, draping characteristics, and also the same strength as that of the fabric. It must be understood that the proposals which have been made for this purpose do not enable the requirement to be satisfied when the composite material for use as reinforcement can or must be formed as a single layer of engineering fabric embedded in a resin matrix. The only way in which adjacent strips can then be connected is to superpose, at least locally, a plurality of layers of bias fabric to form a kind of sandwich at the adjacent edges, thereby significantly increasing the cost price of the final part and giving it dimensional characteristics and strength characteristics that are locally heterogeneous.

Various other propositions have been made in the prior art in attempts to answer the problem as posed above.

Mention can be made of the method of obtaining bias from a unidirectional fabric made up of warp yarns that are small in number relative to the weft yarns.

Such a technique consists in causing the traditional woven cloth to pass between presser rollers beyond which the cloth is taken up by a take-up roller whose axis is inclined at a given angle relative to the direction of the presser rollers.

In order to ensure that the expected results can be obtained durably, it will be understood that it is necessary to make use of fixing or bonding means in the portion lying between the presser rollers and the take-up roller, e.g. means acting where the yarns cross in order to fix the yarns in the newly-imparted orientation. Whatever the means used, such a requirement leads to the bias fabric having significant stiffness so that it is no longer capable of satisfying the requirement of being easy to drape or to lay.

Furthermore, the method used for fixing generally implies adding a bonding material whose presence can have a harmful effect on subsequent behavior of the fabric where it bonds with the matrix of the composite.

Finally, biasing such a conventional fabric necessarily reduces the width of the piece of cloth as initially produced.

Furthermore, such a method gives rise to a fabric in which only one yarn direction is on the bias, which is not exactly the intended object.

Another proposal in the prior art consists in making a fabric with conventional weft yarns and warp yarns but which is produced in the form of a continuous tubular sheath. The principle then consists in cutting such a sheath along a helical path, e.g. oriented at 45°, so that a woven sheath is obtained which, once opened and laid out flat, has its yarns oriented on the bias. Such a sheath can be produced using a conventional loom or a circular loom.

That technique can be considered as constituting an advance over the preceding technique, but it nevertheless suffers from certain drawbacks.

These include the reworking operation constituted by cutting out helically, which operation must be performed accurately in order to obtain rectilinear selvages. For this purpose, it is necessary to implement means for holding and cutting out both the tubular sheath and the separated portions thereof, which represent a non-negligible industrial cost.

Another drawback relates to the feed means used for feeding the weft yarns, both with a conventional loom and with a circular loom.

As a general rule, such yarns are fed either from spools or previously-prepared bobbins possessing limited winding capacity which means that they must be changed periodically, with the need to be able to reestablish yarn continuity by butt-joining, knotting, bonding, or other technical means. Such operations are penalizing on production, increase cost price, and require the presence, in the resulting cloth, of means for bonding or knotting yarns, which cannot be considered as providing the final fabric with characteristics that are uniform in terms of thickness, flexibility, and strength.

Unfortunately, the need to replace spools or bobbins occurs relatively frequently, given that they are of a capacity that generally makes it possible to produce only relatively short lengths of cloth on a continuous basis without bonding yarn.

Furthermore, using a conventional loom gives rise to an additional problem which is that which stems from unwinding yarn from a bobbin that does not rotate about its own axis. This inevitably gives rise to the yarn being twisted. Such a technique is thus completely unsuitable when the fabric needs to be made from flat yarns, whether such yarns are single-strand or multifilament. Such a weaving method using flat yarns subjected to twisting destroys not only the uniform nature of the resulting fabric in terms of thickness, but also in terms of strength and in ability to be draped or laid.

Proposals have also been in the prior art to make use of a similar method to obtain bias fabric. It consists in using an open braiding machine which does indeed make it possible to obtain a strip in which the interlaced yarns are oriented on the bias relative to the direction in which the strip is produced.

Conventionally, an open braiding machine has yarn feed provided from spools which rotate on their own axes, such that in this case also the same problems arise concerning changing yarn.

Furthermore, in general and as a practical manner, an open braiding machine is incapable of providing cloth of a width that is sufficiently broad to provide a positive solution to requirements for bias fabric, in particular in engineering applications.

Thus, there is still a need to be able to obtain bias fabric that can be produced continuously while avoiding all of the defects and drawbacks that arise using the technical solutions that are presently known.

A specific object of the invention is to produce such fabric in the form of a sheet of uniform thickness, appearance, and technical characteristics so as to be suitable for use in various fields of application that require good ability to be draped or laid so as to fit over a reference surface or pattern.

Another object of the invention is to provide means for obtaining a bias fabric that can be obtained at a production rate that is relatively high, and at a manufacturing cost that is advantageous, and that can be made equally well using single-strand or single-filament yarns or multifilament yarns of regular, uniform, and/or heterogeneous shape, and even from optionally single-strand yarns or roving that is naturally flat or that has been shaped to become flat, which characteristic needs to be preserved in the structure of the resulting bias fabric.

SUMMARY OF THE INVENTION

To achieve the above objects, the bias fabric of the invention is characterized in that it is in the form of a cloth of length (L) and of finite width (l), being constituted by interlaced yarns extending in respective directions that are oblique relative to the length (L), and each of which presents no knotting, even for a cloth of indefinite length (L).

The invention also provides a method of continuously manufacturing a bias fabric of above type, such a method being characterized in that it consists in:

warping a sheet of yarns parallel to a direction (x–x') by causing them to be taken in charge by first and second transfer means occupying mutually parallel directions (y–y') at an angle ($\alpha$) with the direction (x–x');

progressively building up said sheet by placing the yarns successively along a sheet set-up edge;

moving said yarns by the first and second transfer means through one step in the oblique transverse direction from the set-up edge towards an opposite "take-up" edge;

causing the yarn occupying the take-up edge additionally to be taken in charge by a third transfer means situated at a distance from and parallel to the first transfer means in order to act substantially on the middle portion of said yarn;

opening the sheet to form two half-sheets so as to define a sheet close to the first and the third transfer means;

cutting the set-up yarn brought substantially over the take-up edge substantially in the middle portion thereof;

leaving in place that portion of said yarn that is held by the inlet of the third transfer means and by the outlet of the first transfer means to constitute a yarn of the future cloth;

taking the segment of said yarn that is situated between the third and the second transfer means and inserting it into the shed along a direction perpendicular to the direction (x–x') from the take-up edge towards the set-up edge so as to constitute a yarn of the future cloth; and proceeding in the same manner in succession with each yarn brought to the take-up edge while also placing a new yarn along the set-up edge and progressively building up an interlace of yarn segments taken in charge by the first and third transfer means and progressing along the direction (α) that is oblique relative to the direction (x–x').

Finally, the invention also provides a loom for producing a fabric of the above type, the loom being characterized in that it comprises:

a section for warping a sheet of yarns that are set up in succession parallel to one another from a sheet set-up edge;

first and second handling and transverse transfer means extending obliquely relative to said yarns towards a "take-up" edge of the sheet, said means extending parallel to each other along a direction (α) that is oblique relative to the direction of the yarns, said oblique direction defining the direction in which the cloth is produced;

third means set up at a distance from and parallel to the second means and driven in the same direction as the first two means so as to take in charge the substantially middle portion of the yarn of the sheet that occupies the take-up edge;

a section for opening and closing the sheet to form two half-sheets so as to define a shed upstream from the first and second handling means in the cloth production direction;

means serving firstly to cut the yarn of the sheet that occupies the take-up edge at a point upstream from the third handling means, and secondly to leave a portion of yarn for constituting one of the yarns of the cloth in place between the first and third handling means, while also taking hold of the segment of yarn extending between the cut and the second handling means and inserting it into the open shed; and means for beating each inserted yarn segment and causing it to be taken in charge by the first and third means which guide the resulting bias fabric.

Various other characteristics can be seen in the following description given with reference to the accompanying drawings which show embodiments of the invention as non-limiting examples.

DETAILED DESCRIPTION OF THE INVENTION

Figure 1:
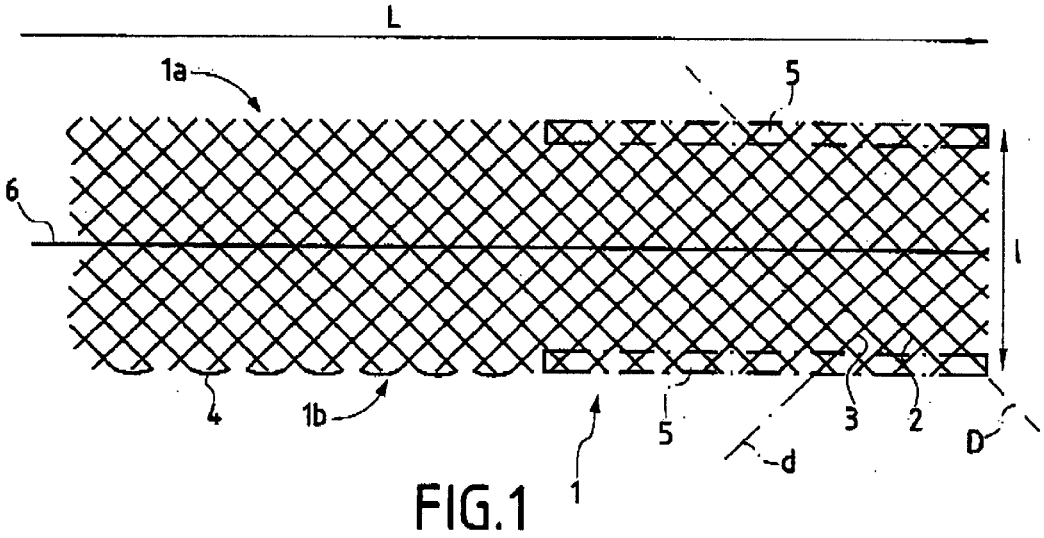
FIG. 1 is a diagrammatic plan view showing a portion of a piece of bias fabric in accordance with the invention.

The bias fabric of the invention is shown diagrammatic in FIG. 1 in which it can be seen that the fabric is in the form of a piece of cloth 1 of length L and of finite width l. Relative to the width, the length L can be considered as being indefinite, i.e. capable of presenting considerable yardage while presenting structural characteristics that are uniform over the entire length.

The cloth is made up of yarns 2 and 3 which are interlaced or crossed with any suitable weave, and the most general case being taffeta weave. The yarns 2 and 3 extend along respective directions D and d which are oblique relative to the direction of the length L. The directions D and d are preferably orthogonal and symmetrical about the direction L, each forming an angle relative thereto which is generally referred to in the art as ±45°.

Naturally, while still remaining mutually orthogonal, the directions D and d could slope at different angles relative to the direction of the length L, naturally giving rise to the resulting fabric having non-uniform behavior because of the different and non-symmetrical angles relative to the direction L, which angles are complementary in value, such as +50° and −40°, for example.

According to another characteristic, the yarns 2 and 3 are of finite length and they are interrupted on at least one selvage such as 1*a* relative to the other such as 1*b*.

In one implementation, and as can be seen below, the cloth can have yarns such as 2 in which every other yarn forms a loop 4 at one of the selvages, such as 1*b*.

The cloth 1 can also have selvages 1*a* and 1*b* fitted with respective cords 5 made of ribbon or string, or indeed by being coated in suitable material, applied during manufacture so as to hold captive either the cut ends of the yarns 2 and 3 or the loops 4.

In a variant embodiment, the cloth 1 has at least one straight reinforcing yarn 6 extending parallel to the direction L of the cloth. Such a reinforcing yarn is then held captive between the yarns 2 and 3 and be constituted by a single strand or multiple strands, a single filament or multiple filaments, and can be of section that is flat and thin or it can be of a shape such that its right cross-section is different, e.g. circular. The individual yarns 2 and 3 can be made of any suitable material, and in particular of carbon fibers.

On the basis of the technical means that are usually implemented, it is possible to make a cloth 1 of width l equivalent to that of cloth produced on a conventional loom.

According to a characteristic of the bias fabric of the invention, the cloth is produced over an indefinite length L using individual yarns 2 and 3 none of which has an interruption compensated by any kind of junction or knot, as occurs in conventional weaving, braiding, or knitting methods. This characteristic is essential and crucial for consideration in the meaning of the invention, even when the length L of the cloth 1 is indefinite.

According to another characteristic which is likewise essential and crucial in the meaning of the invention, the cloth 1 can be produced over an indefinite length L using individual yarns 2 and 3 that are flat in shape and which, under such circumstances, have no twisting over their entire length, even when the yarns 2 form open loops 4 at one of the selvages, such as 1*b*.

To obtain the bias fabric as described above, the invention proceeds as follows.

Figure 2:
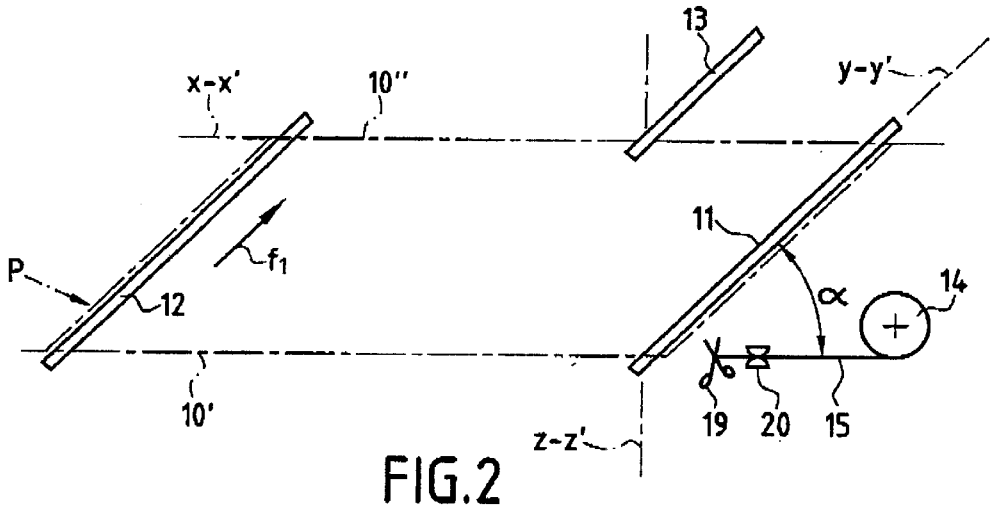
FIGS. 2 to 6 are diagrammatic views showing various stages in the implementation of the invention.

Firstly, a warping plane P is defined as shown in chain-dotted lines in FIG. 2, so as to have a "set-up" edge 10' and a "take-up" edge 10" which is parallel to the set-up edge 10'. The plane P is also defined transversely to the edges 10 by first and second handling and transfer means 11 and 12 which are parallel to each other and which extend across the entire width between the edges 10, while extending at a determined angle α, e.g. equal to 45°, relative to the direction x–x' of said edges. The means 11 and 12 thus occupy a second direction y–y' which is oblique relative to the direction x–x'.

According to a condition of the invention, the distance between the parallel means 11 and 12 is advantageously selected to be at most equal to or sightly less than twice the width that extends between the edges 10' and 10" perpendicular to the direction x–x'.

The method also makes use of third handling and transfer means 13 extending along the same direction α relative to the reference direction x–x' from the take-up edge 10" which it intercepts via its inlet section while being disposed parallel to the means 11.

The means 11 to 13 can be driven in the direction represented by arrow $f_1$ to perform synchronous displacements that are intermittent, or stepwise, or even continuous.

Figure 3:
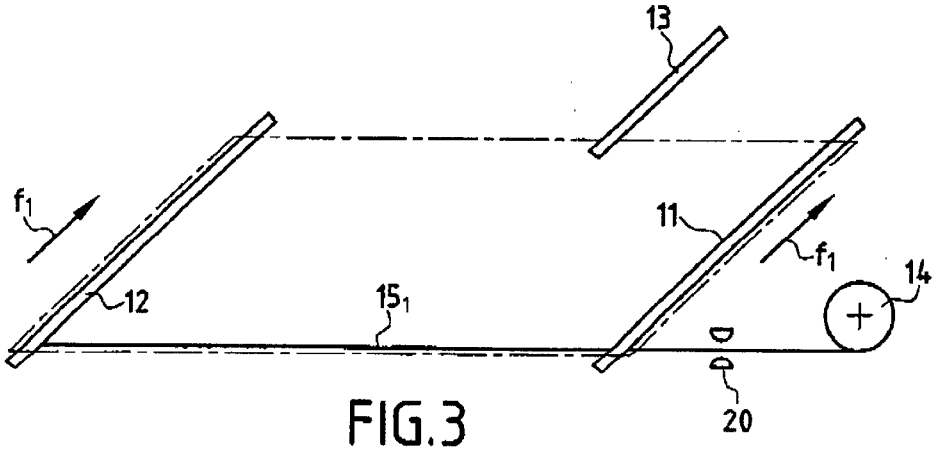

In a first stage of the method as shown in FIG. 3, a yarn 15 is unwound from a reel 14, and is set up under relative tension along with the edge 10' while ensuing that it is taken up by the means 11 and 12. Once the yarn 15 has been set up as mentioned above, it is cut upstream from the handling means 11 in the unwinding direction, so that only an individual yarn $\mathbf{15}_1$ then remains on the warp plane P.

In another stage of the method, the means 11 and 12 driven simultaneously in the direction of arrow $f_1$ then move the yarn $\mathbf{15}_1$ through one step in the transverse direction so as to make it possible, as described above, to set up a second yarn $\mathbf{15}_2$ along the set-up edge 10'.

Figure 4:
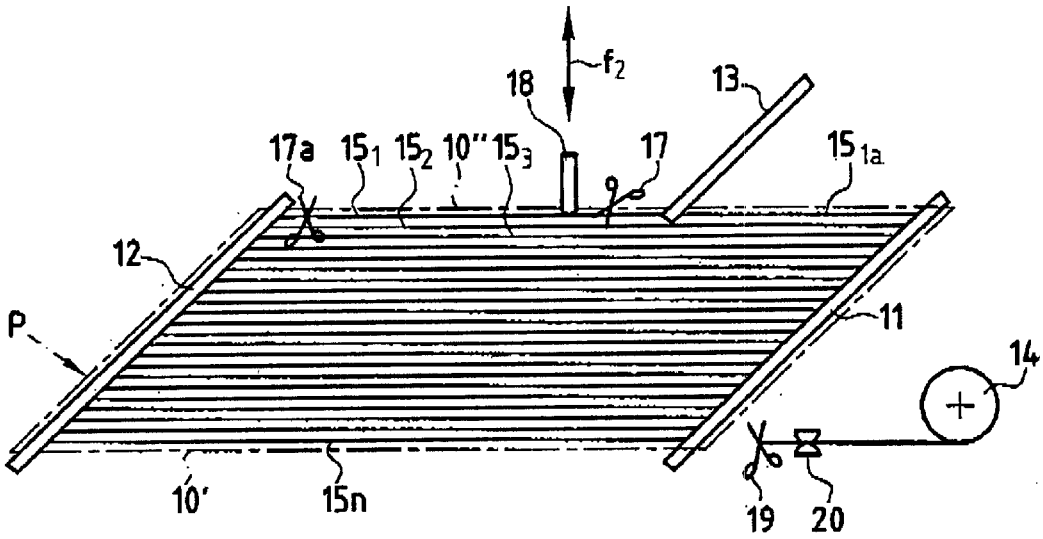

The above-described process is repeated by intermittent operation of the handling and transfer means 11 and 12 as many times as are necessary to fill the warping plane P completely with a succession of yarns 15, with the last yarn $\mathbf{15}_n$ in FIG. 4 being set up along the edge 10' while the first yarn $\mathbf{15}_1$ lies in the vicinity of the take-up edge 10" while still being held by the means 11 and 12. It should be observed that in this state, the yarn $\mathbf{15}_1$ is then also taken in charge, substantially in its middle, by the inlet of the means 13.

Advantageously, in order to ensure that this condition is achieved in suitable manner, the method makes use of means 13 having an inlet in alignment with the inlet of the means 11 so that this alignment occupies a direction z–z' that is perpendicular to the direction x–x'.

Figure 5:
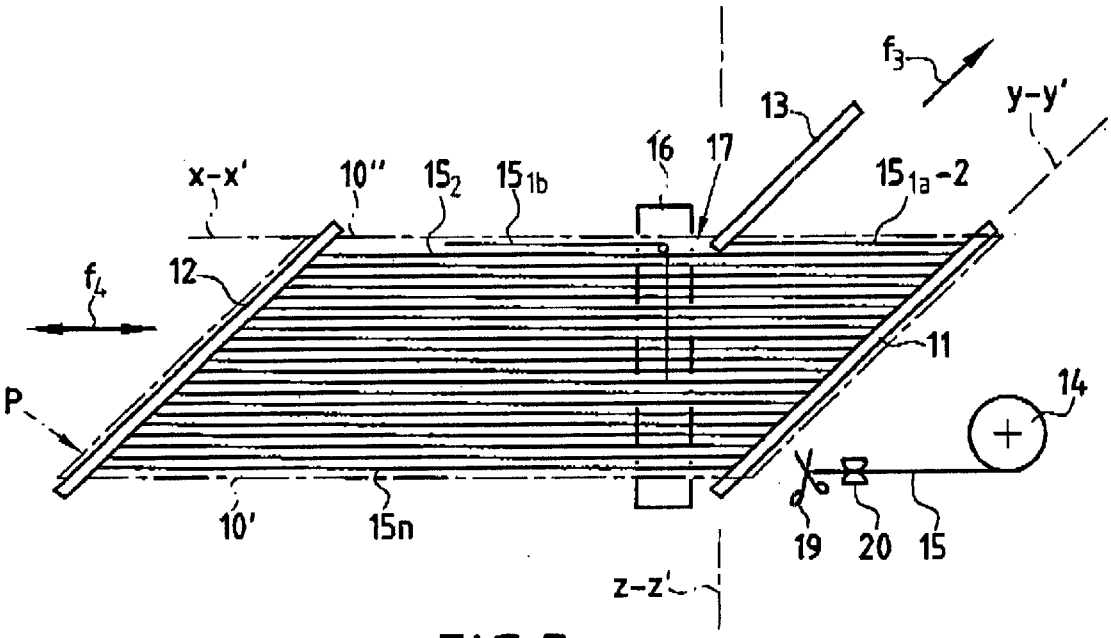

In this situation, as shown in FIG. 5, a shed is opened in a zone such as 16 situated beyond the aligned inlets of the means 11 and 13. Such opening is performed by means suitable for moving the sheet of yarns $\mathbf{15}_1$ to $\mathbf{15}_n$ warped over the plane P so as to provide two half-sheets each comprising equal numbers of yarns when the weave to be performed is of the taffeta type. Under such circumstances, the shed 16 can be opened by lifting every other yarn, for example. A similar result would be obtained by moving every other yarn downwards or by moving every other yarn upwards and the intervening yarns downwards. The person skilled in the art knows how to perform this requirement to open the shed when it is necessary to perform a different type of weave.

In a following stage, the yarn $\mathbf{15}_1$ is cut by a member 17 situated immediately upstream from the inlet of the transport means 13 (FIG. 4) so as to leave a segment of yarn $\mathbf{15}_{1a}$ between the inlet to the means 15 and approximately the outlet of the first means 11, which segment is for use subsequently in constituting a yarn 2 of the cloth 1. The second portion $\mathbf{15}_{1b}$ of the cut yarn $\mathbf{15}_1$ remains held between the outlet of the means 12 and a holding and insertion member 18 suitable for being driven to move at least in the direction $F_2$.

This segment of yarn $\mathbf{15}_{1b}$ is then inserted into the shed 16 by the member 18 so as to extend parallel to the inlets of the handling means 11 and 13 along the direction z–z' so as subsequently to be engaged therein by a beating operation that can be considered as being conventional in weaving.

The same is then performed on each of the yarns $\mathbf{15}_2$, $\mathbf{15}_3$, . . . brought in succession to the take-up edge 10" while successive yarns are set up along the edge 10' so that a complete warping plane of yarns 15 is always present.

Figure 6:
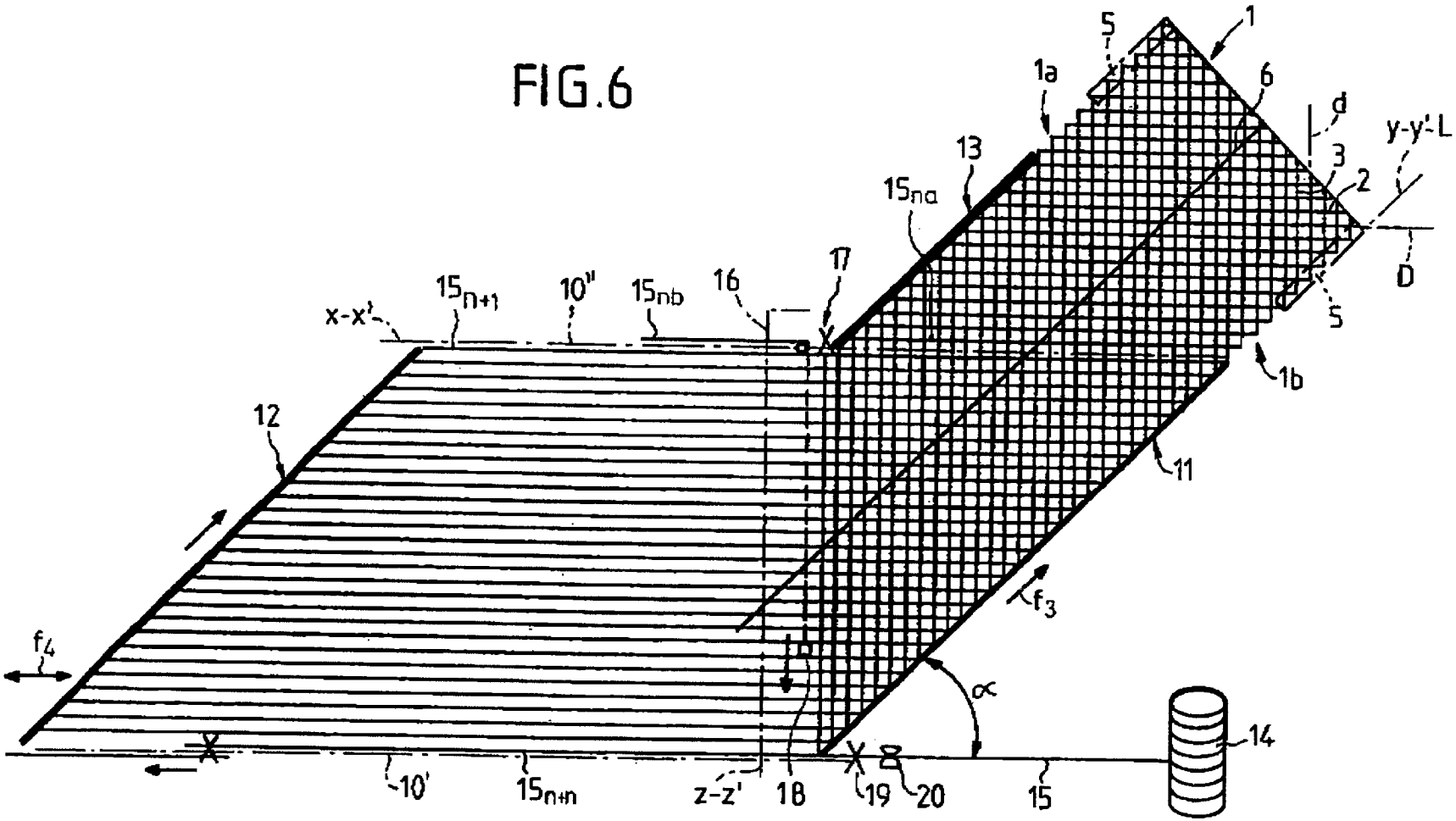

As a result, each yarn segment $\mathbf{15}_{nb}$ extending between the inlet of the transport means 13 and the inlet of the transport means 11 is inserted into the shed 16 and is taken in charge by the transport means 11 and 13 thus constituting an individual yarn crossing the yarns 2 that are held between the transporters 11 and 13, and as can be seen in FIG. 6, thus forming a piece of cloth which advances in the direction of arrow $f_3$ along the axis y–y' defining the production direction L.

From FIG. 6, it can be seen that the cloth 1 is built up progressively from yarns 2 and 3 which are mutually perpendicular while being oriented obliquely relative to the advance direction y–y'–L at the angle α. In the present case, the bias-woven cloth can be referred to as having yarns 2 and 3 at a ±45° orientation.

The above-described method makes use of various auxiliary stages, one of which is fitting the second means 12 on a sliding carriage or on an oscillating mount suitable for being moved in the direction of arrow $f_4$ to accommodate the change in the length of the yarns $\mathbf{15}_n$ when the shed 16 is opened.

In the method described, each yarn $\mathbf{15}_n$ set up along the edge 10' corresponds to unwinding a unit length from the reel 14 that is approximately the same as the length of warping plane P, and then in cutting by means of a member 19 situated between the reel 14 and the means 11, and preceded by a holding clamp 20 or the like (FIG. 2).

The yarn 15 could be set up without being cut, e.g. by means of a zigzag picking carriage causing the yarn 15 from the reel 14 to be set up continuously on the means 11 and 12 which are then provided with pins, fingers, needles, or other technical means suitable for holding the yarn that is unwound continuously and looped in alteration. Under such circumstances, the yarn $\mathbf{15}_n$ occupying the edge 10" is cut by means of a member 17 and a corresponding member $\mathbf{17}_a$ located close to the means 12 (FIG. 4).

Another variant of the method consists in lining the selvages 1*a* and 1*b* of the cloth 1 with cords 5 serving to stop the ends of the yarns 2 and 3 that result from the successive cuts made to each yarn 15. Each cord 5 can be constituted by a ribbon or a string or a strip of suitable material, or indeed can be the result of applying a coating of material selected from those suitable for possessing residual flexibility that is compatible with that of the cloth 1, which material can be applied by rolling, sampling, or molding. Each cord 5 can be applied definitively or temporarily.

As can be seen from the above-described method, the invention makes it possible to make up a cloth 1 of finite width l and of indefinite length L while using only a single yarn such as 15 taken from the reel 14 so as to constitute the individual yarns 2 and 3 which are consequently always free of any junction, knotting, or bonding points, regardless of the length of the cloth 1. The resulting cloth is homogeneous in structure, in appearance, and in its technical characteristics, and it can be manufactured over an indefinite length, merely by replacing a large capacity reel 14 which need only be changed whenever the yarn that remains thereon is no longer sufficient to deliver an individual length of yarn suitable for being set up between the inlets of the transporters 11 and 12.

This characteristics makes it possible to obtain uninterrupted industrial production rates and to produce a piece of bias fabric of indefinite length without the manufacturing process being subjected to the interruptions that are necessary in conventional weaving for knotting interrupted yarns when changing spools in particular, and also for performing intermediate operations such as warping and filling spools and bobbins. This gives rise to a considerable reduction in production costs.

In a variant, it can be observed that the yarns $\mathbf{15}_n$ can be taken from more than one reel 14, optionally in alternation, each yarn corresponding to a determined fineness and/or material.

Naturally, the operation of opening the shed 16 as described above causes the yarns concerned to move locally in an upward and/or downward direction so as to implement the weave desired for the yarns 2 and 3 in a manner that is conventional in weaving. Such opening can be implemented by using a system of combs that provide functions of laterally guiding each yarn, and of opening and closing the half-sheets, and of beating each segment of yarn cut from the segment occupying the take-up edge 10".

FIG. 6 shows that in a variant of the method, provision can be made to take advantage of opening the shed 16 for the purpose of inserting at least one straight reinforcing yarn 6 that is held captive between the interlaced yarns 2 and 3 and that extends parallel to the y–y' direction.

Figure 7:
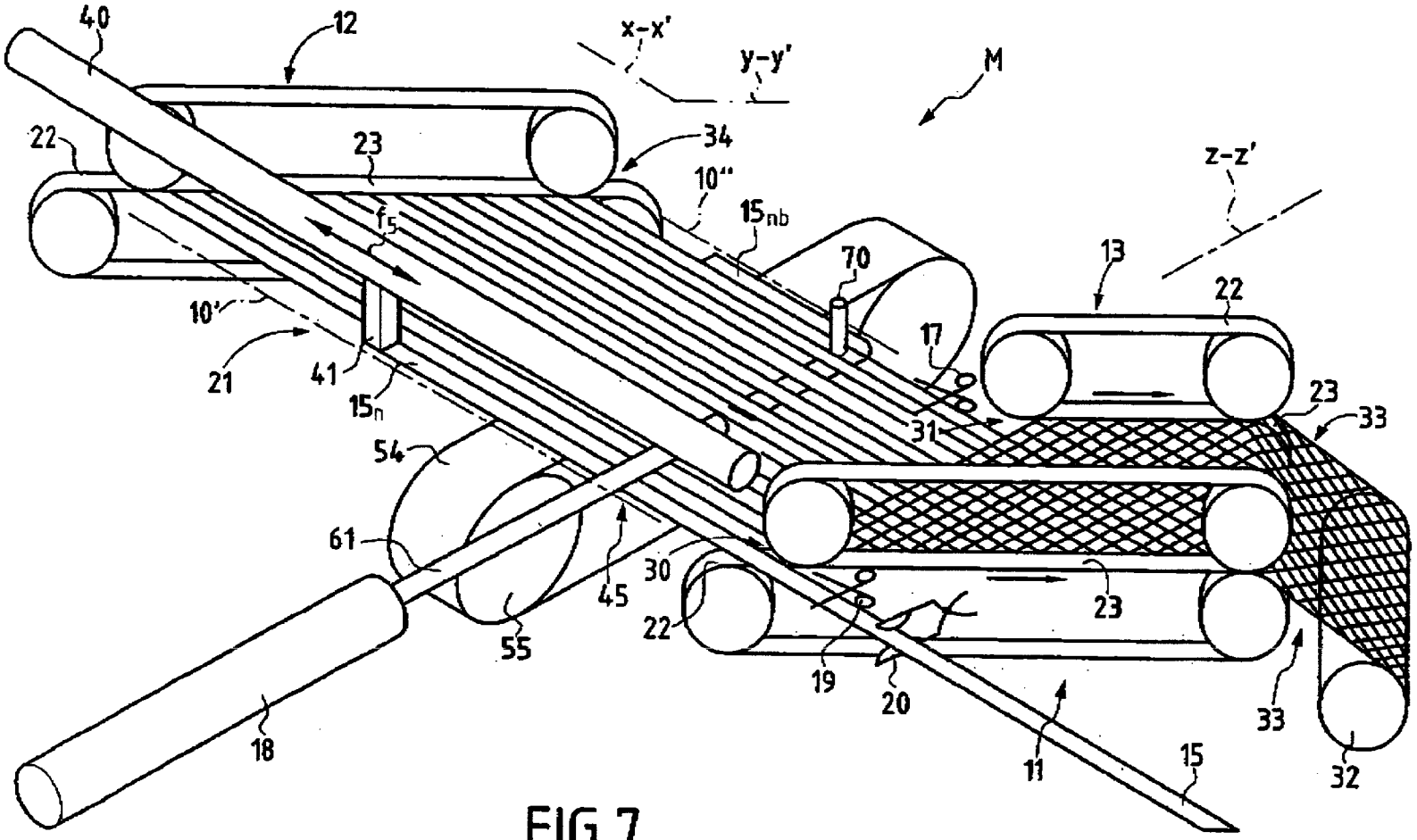
FIG. 7 is a diagrammatic perspective view showing the loom for implementing the method of obtaining bias fabric of the invention.

FIG. 7 is a diagram showing one example of a loom structure suitable for implementing the above-described method to obtain a bias fabric of the invention.

In the figure, the structure of the loom is generally horizontal, but it is clear that it would also be possible to envisage having a loom of generally vertical structure.

The loom given overall reference M comprises a warping section 21 for defining the above-described plane P. This warping section 21 is essentially constituted by the two take-up transporters 11 and 12 which form the mutually parallel means for taking the various warped yarns $\mathbf{15}_n$ in charge and moving them transversely as described above.

In the example shown, each of the transporters 11 and 12 is constituted by two pairs of endless conveyor belts in which the top and bottom strands 22 and 23 face each other in a superposed configuration and are pressed together so as to hold the end portions of each warp yarn $\mathbf{15}_n$. The conveyor belts 22 and 23 can be simple belts or they can be belts having pins or needles or catching or even adhesive coatings.

To define a set-up edge 10' and a take-up edge 10", the bottom conveyor belts 23 of the means 11 and 12 are shorter in length than the belt 22 so as to define inlet and outlet zones, so to speak, for the yarns $\mathbf{15}_n$. As mentioned above, the two means 11 and 12 are disposed parallel to each other and they are of the same length, each being at an angle $\alpha$ relative to the direction of the edges 10' and 10" of the plane P whose set-up length occupies the direction x–x'. Relative to this direction, the transporters 11 and 12 are oriented along the y–y' direction which corresponds to the direction L in which the bias fabric is produced. The means 11 and 12 are spaced apart from each other along the direction x–x', preferably by a distance which is twice the width measured perpendicularly to the direction x–x' between the edges 10' and 10".

The loom also comprises third handling and transfer means given reference 13 and having the same structural characteristics as the means 11 and 12, or having characteristics that are technically equivalent. In the example shown, the means 13 thus also comprises top and bottom conveyor belts 22 and 23. The means 13 are situated parallel to the means 11, so that the inlet thereto is suitable for taking charge of the warp yarn that occupies the take-up edge 10", in the middle portion thereof. For this purpose, the inlet 30 to the means 12 and the inlet 31 to the means 13 are in alignment on the direction z–z' which is orthogonal to the direction x–x'.

In the example shown, the angle $\alpha$ is close to 45° and the length of the third handling and transfer means 13 is determined so that its outlet is substantially in alignment with the outlet from the means 12 in a direction that is perpendicular to the direction y–y'.

The handling and transfer means are used to cause the yarns $\mathbf{15}_n$ of the warped sheet to move in the oblique direction y–y', and for this purpose they are driven by drive means (not shown, but conventional for this purpose), preferably so as to move sequentially and intermittently at a step size corresponding to the spacing that is to be provided between adjacent yarns $\mathbf{15}_n$ in the warped sheath. Naturally, it must be understood that it is possible to cause the means 11 to 13 to move synchronously and continuously, providing the means for setting up each yarn $\mathbf{15}_n$ are capable of laying down each individual length of yarn in non-critical time so as to ensure that the yarns are laid parallel in the warping plane P.

At a distance from the outlet of the handling means 11 and 13, the loom has a cylinder 32 onto which the resulting cloth 1 is rolled. This distance is advantageously used to receive means 33 capable of binding the selvages of the resulting cloth 1 by means of cords, ribbons, tapes, etc. or indeed to coat them in any suitable material. It should be understood that such coating could also be achieved by previously depositing a layer of adhesive substance, e.g. at the inlets to the means 11 and 13, for the purpose of holding the ends of the yarns and subsequently of being unstuck from the conveyor belts so as to constitute coatings for the selvages.

Such a take-up method can also be used for the conveyor belts of the means 12 by additionally providing the outlet zone 34 with a peel-off film suitable for stripping the conveyor belts 22 and 23 as they move away from the take-up edge 10".

The loom also has a device 40 for putting each individual yarn $\mathbf{15}_n$ into position along the set-up edge 10'. By way of example, such a device can be constituted by a gripping clamp 41 fitted to a carriage or other drive member suitable for being guided in motor-driven reciprocating displacement in one or both directions specified by the arrow $f_5$, so as to be capable of taking the yarn 15 as its comes from the reel 14 and causing it to pass over the inlet section of the transporter 11 and then bringing it to the inlet section of the transporter 12.

The stroke along the arrow $f_5$ takes account of the presence of the cutting member 19 situated beyond the clamp 20 relative to the direction in which the yarn is unwound from the reel 14. The position of the clamp 20 can be considered as being approximately the position where the clamp 41 picks up the yarn during the stage of extending and unwinding the yarn 15.

The loom also comprises a section 45 for opening and closing the shed 16 by acting on the sheet of warped yarns so as to split it into two half-sheets. As shown in FIGS. 7 to 12, such a system 45 comprises a plurality of combs 50 or the like for picking up the yarns $\mathbf{15}_n$ to guide them laterally and transfer them stepwise, where appropriate, while maintaining the selected relative spacing therebetween. Advantageously, each of these combs 50 is constituted by two walls 51 defining a kind of upwardly-directed bracket for guiding a yarn $\mathbf{15}_n$. The walls 51 are mounted at the ends of respective elastically deformable blades 52 connected to a displacement drive system 53 suitable for being implemented in various different ways.

Figure 9:
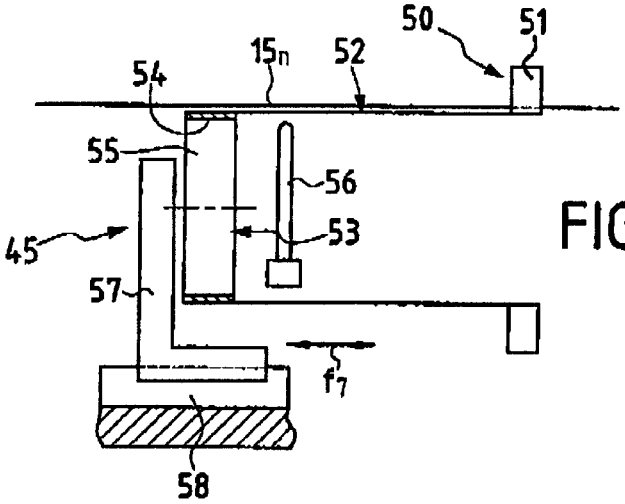
FIGS. 9 to 12 are diagrammatic views showing certain component members of the loom.
Figure 10:
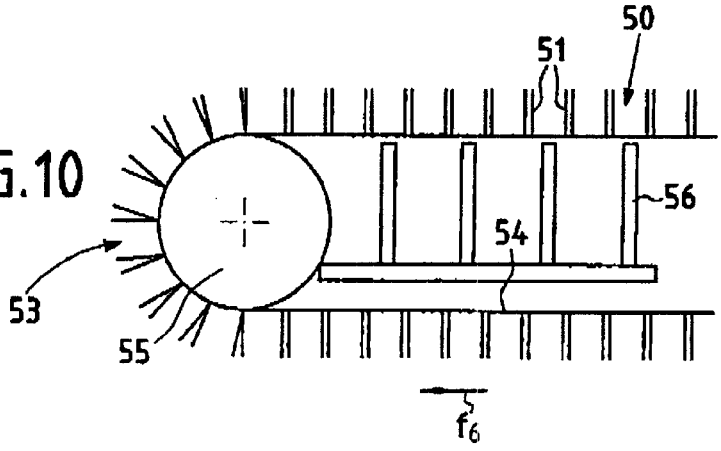

By way of example, as shown in FIGS. 9 and 10, the system 53 is constituted by an endless belt 54 suitable for being driven to move intermittently in the direction of arrow $f_6$ by passing over return members 55 having the effect of setting up some of the blades 52 in a common plane beneath the warping plane P so that said bars are oriented as upwardly-open brackets. It should be understood that a different structure could consist in fitting the blades 52 to a carriage suitable for being driven with reciprocating motion while being associated with a retraction system so that each comb 50 can move laterally in the transverse direction together with the yarns $\mathbf{15}_n$ on each incremental step, and can subsequently be lowered so as to be brought beneath the sheet of warped yarns in order to enable it to be returned to an initial position in which it is again raised so as to take charge of another yarn $\mathbf{15}_n$.

Figure 11:
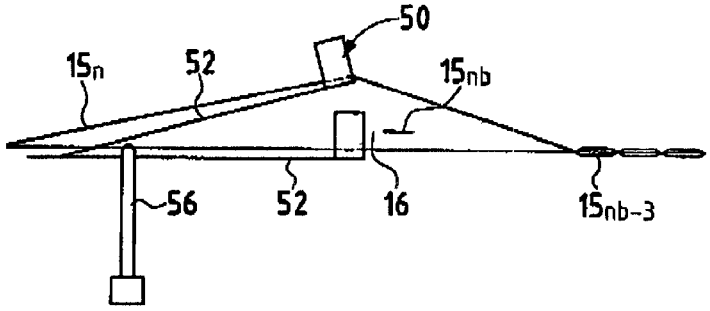

Whatever the system implemented, the blades 52 are also associated with elevator pushers 56 that can be controlled in any suitable and selective manner as a function of the selected weave in order to be raised from a retracted position, as shown in FIGS. 9 and 10, to a raised position as shown in FIG. 11. Each raised pusher acts on the corresponding blade to deform it upwards so that the comb 50 lifts the corresponding yarn $\mathbf{15}_n$, so that relative to the yarns left in place, it defines the shed 16 into which the segments of yarn $\mathbf{15}_{nb}$ cut from the yarn $\mathbf{15}_n$ occupying the take-up edge 10" is inserted, as described with reference to the method.

The above-described opening and closing system 45 is advantageously mounted on a frame 57 which is carried by a bench 58 relative to which it can be moved by a suitable drive member so as to be driven in both directions relative to the arrow $f_7$ from the initial position in which it opens the shed 16.

Figure 12:
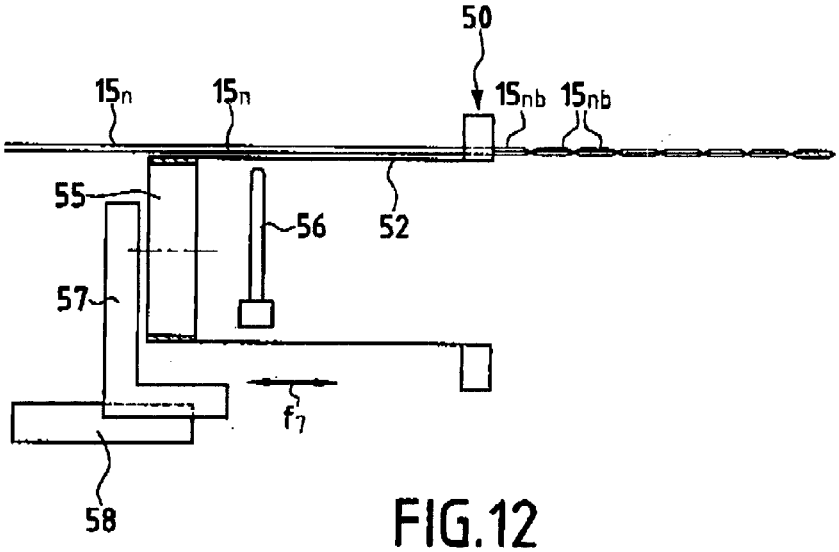

Thus, after the yarn segment $\mathbf{15}_{nb}$ has been inserted into the shed 16, as shown in FIG. 11, the pushers 56 are caused to retract so as to return the set of combs into the original position in which they are in alignment parallel to the warping plane P (FIG. 12). In this state, the drive member is controlled to cause the entire system to move along the bench 58 towards the aligned inlet sections 30 and 31 of the take-up means 11 and 13 so that the various combs 50 perform the function of a sley to beat and press the inserted yarn segments $\mathbf{15}_{nb}$ against the preceding segments in the same manner as occurred in conventional weaving, as shown in FIG. 12.

Finally, the loom is further provided with the holding and insertion member 18 for taking charge of the free end after the segment $\mathbf{15}_{nb}$ has been cut from the yarn $\mathbf{15}_n$ occupying the take-up edge 10" in order to insert it in the shed 16. Such a member can be constituted by a gripping clamp fitted to the end of a rod 61 suitable for being inserted into the shed, e.g. from the set-up edge 10'. Naturally, an opposite configuration could also be envisaged. In all cases the rod is driven over a reciprocating rectilinear stroke that is long enough to insert the cutoff yarn segment $\mathbf{15}_{nb}$ into the shed 16 over the entire width of the warped sheet.

Naturally the rod 61 could also be replaced by two opposite half-rods, each provided at its end with complementary holding means and driven to perform synchronized opposite rectilinear displacements.

Figure 8:
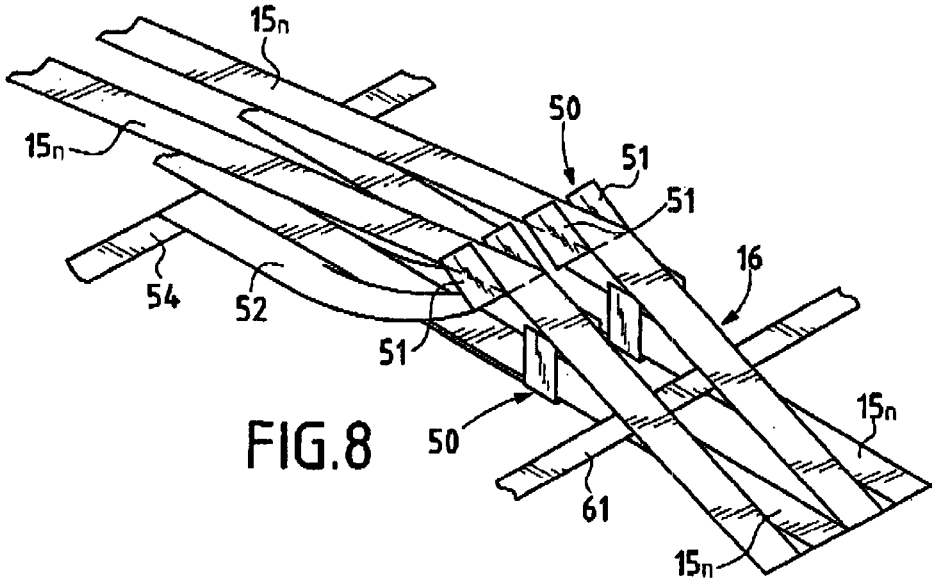
FIG. 8 is a fragmentary perspective view showing up certain component elements of the loom.

Provision could also be made for the member 61 to be implemented in the form of an actuator having reciprocating rectilinear motion, provided with lateral holding means held parallel to the yarn segment that is to be cut off at the take-up edge 10" while in a waiting position. Such a holding member would then be mounted on a vertical pivot situated close to the cut in the yarn so that after taking charge, it can be rotated to bring the holding clamp 18 that it carries onto the axis of the shed, so that the cutoff and fully extracted yarn segment $\mathbf{15}_{nb}$ is inserted into the shed. As shown in FIG. 8, the member 61 is disposed to take charge of the end of the segment $\mathbf{15}_{nb}$ cut off by the cutting member 17 which is situated close to the inlet section 31 of the means 13.

When the holding member 61 is of the type shown diagrammatically in FIG. 7, the loom is also fitted with a bending finger 70 which is constituted in one embodiment by a cylindrical vertical peg located substantially level with the take-up edge 10" and at a distance from the cutting member 17. Such a finger is retractable so as to be capable of being caused to rise after the yarn $\mathbf{15}_n$ brought to the edge 10' has moved in the transverse direction.

An operating sequence can then be set up as follows.

The holding member such as the clamp 18 takes hold of the yarn $\mathbf{15}_n$ occupying the take-up edge 10", and then the cutting member 17 is actuated to cut said yarn so as to leave a first segment of yarn $\mathbf{15}_{na}$ which is held at the outlet from the means 11 and at the inlet of the means 13 so as subsequently to constitute a yarn 2.

The member 18 is then caused to travel inside the shed 16 along a direction perpendicular to the direction x–x' so that the cutoff segment of yarn $\mathbf{15}_{nb}$ is driven and caused to pass round the bending point 70 so as to be located and suitably aligned inside the shed 16.

Figure 13:
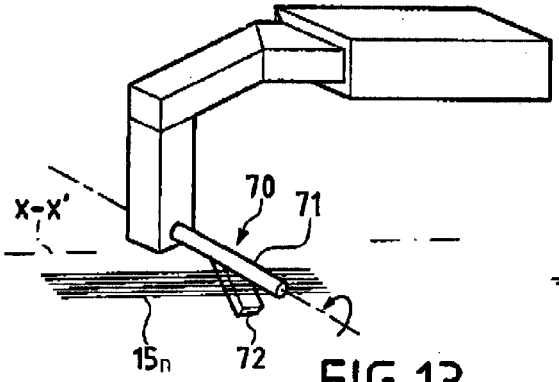
FIGS. 13 and 14 are perspective views showing certain structural details of the loom.

In a greatly preferred application, the yarn used and unwound from the reel 14 is of the flat type, e.g. being constituted by a multifilament association of carbon fibers which can be of the 3K, 6K, 12K, or even of the 24K, 48K, 80K type, for example. In one implementation, it is essential to be able to insert the flat yarn segment $\mathbf{15}_{nb}$ into the shed 16 without subjecting it to any twisting of the kind that would normally occur on going round the bending point 70. To comply with this requirement, the bending point 70 can then advantageously be implemented as shown in FIG. 13 by being constituted by a finger 71 associated with a tongue 72 co-operating with the finger to define a through notch of small width. Above the sheet of warped yarn $\mathbf{15}_n$, the finger 71 extends so that the last yarn occupying the take-up edge 10" is engaged between the finger 71 and the tongue 72. In addition, the bending point 70 is disposed in such a manner that the finger 71 extends obliquely relative to the direction x–x', being oriented at 45° so as to be directed towards the shed 16.

In this manner, when the yarn segment $\mathbf{15}_{nb}$ is taken, it is automatically caused to wind round an open half-loop on the finger 71 which thus provides bending through 90° relative to its original direction without inducing any twisting effect.

Figure 14:
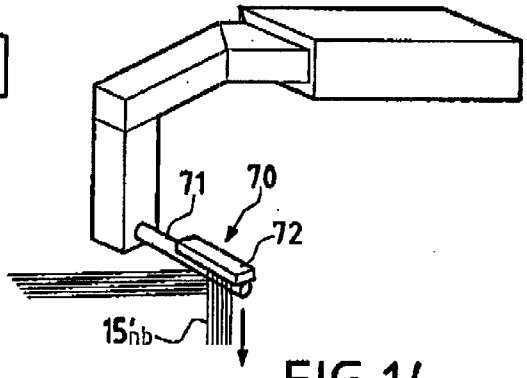

The same effect can be obtained by using dynamic members instead of static members by replacing the finger 71 with a turn-over bar suitable for being driven, possibly by being rotated on its axis through 180° immediately after the cutting member 17 has been actuated so that the end portion $\mathbf{15'}_{nb}$ lying between the turn-over bar and the cutting member is automatically directed after turning over in the direction which favors take-up by the holding member such as 18 moving parallel to the shed 16, as shown in FIG. 14.

The bending point 70 could also replace the bar 72 with a shoe or jaw for relative clamping of the end portion $\mathbf{15'}_{nb}$.

Finally, the loom can include a device for inserting at least one straight reinforcing yarn such as the yarn referenced 6 in FIGS. 1 and 6. Such a device given overall reference 80 in FIGS. 15 and 16 comprises a yarn-guiding bar 81 carrying at least one eyelet 82 through which the yarn 6 is engaged, which yarn is unwound from a superposed reel (not shown). The yarn-guiding bar 81 is placed in abutment against the combs 50 between the combs and the aligned inlets 30 and 32 of the handling and transfer means 11 and 13. Beyond the eyelet 82, each yarn is inserted into the shed 16 so as to be held captive in a crossover zone between a yarn 2 and a yarn 3 making up the bias fabric 1.

Figure 15:
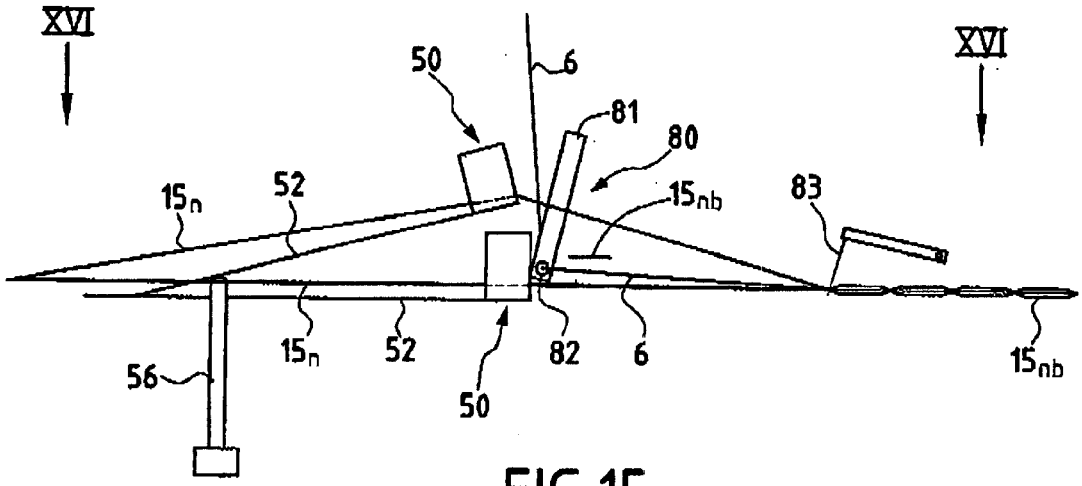
FIG. 15 is a diagrammatic elevation view showing other structural elements of the loom in a variant embodiment.
Figure 16:
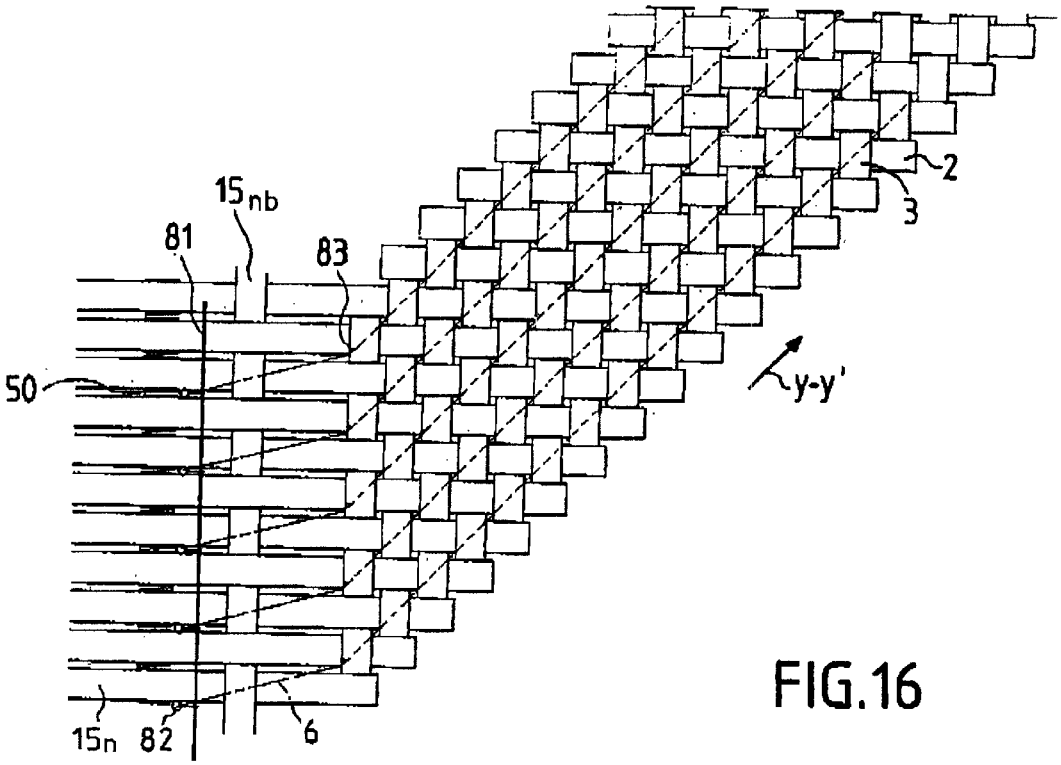
FIG. 16 is a plan view taken substantially on line XVI—XVI of FIG. 15.

FIGS. 15 and 16 show how it is possible to insert a plurality of straight reinforcing yarns 6, in which case it is appropriate to be able to cause them to be held captive so that they extend parallel to the direction in which the fabric is being formed, as defined by the axis y–y'. Under such circumstances, the insertion device then comprises, for each reinforcing yarn 6, a retractable needle 83 which, in a low position, as shown in FIG. 15, serves to hold the captive portion of the reinforcing yarn 6 level with the last inserted yarn 3 and at a distance from the eyelets 82.

Figure 17:
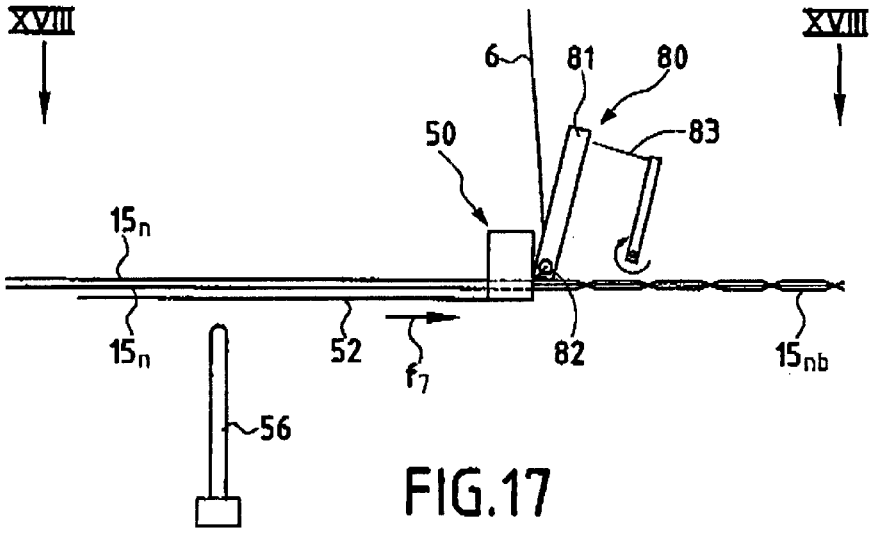
FIG. 17 is an elevation view analogous to FIG. 15 but showing another functional characteristic.

During the beating operation, performed as described above by the combs 50, the needles 83 are retracted as shown in FIG. 17 so as to enable insertion at the bottom of the crossover with the last segment $\mathbf{15}_{nb}$ of inserted yarn. During the stage in which the combs 50 are retracted, the needles 83 are driven in the opposite direction to hold each yarn 6 in the waiting position, as shown in FIG. 18.

It should be observed that in order to obtain the desired result, each pivoting needle 83 is offset from the corresponding eyelet 82 by one width of an individual yarn $\mathbf{15}_n$.

Figure 18:
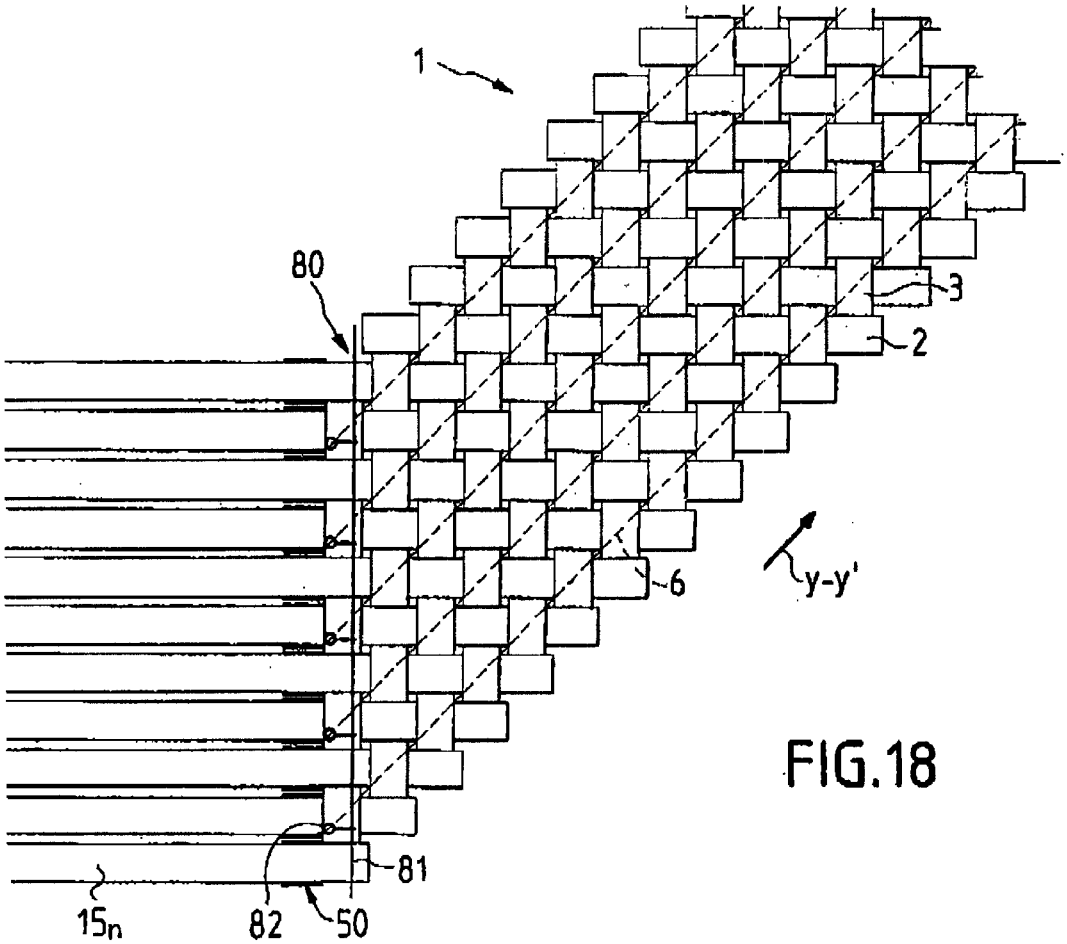
FIG. 18 is a plan view taken substantially on line XVIII—XVIII of FIG. 17.
Figure 19:
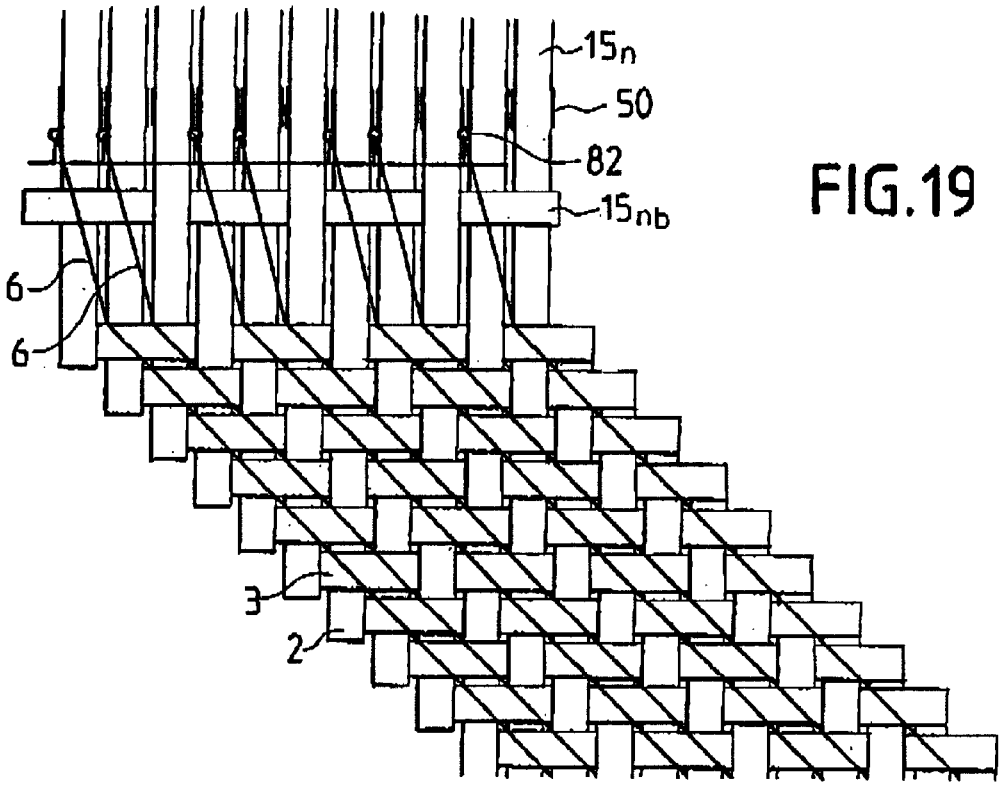
FIGS. 19 and 20 are plan views analogous to FIGS. 16 and 18, but showing an example of another weave.
Figure 20:
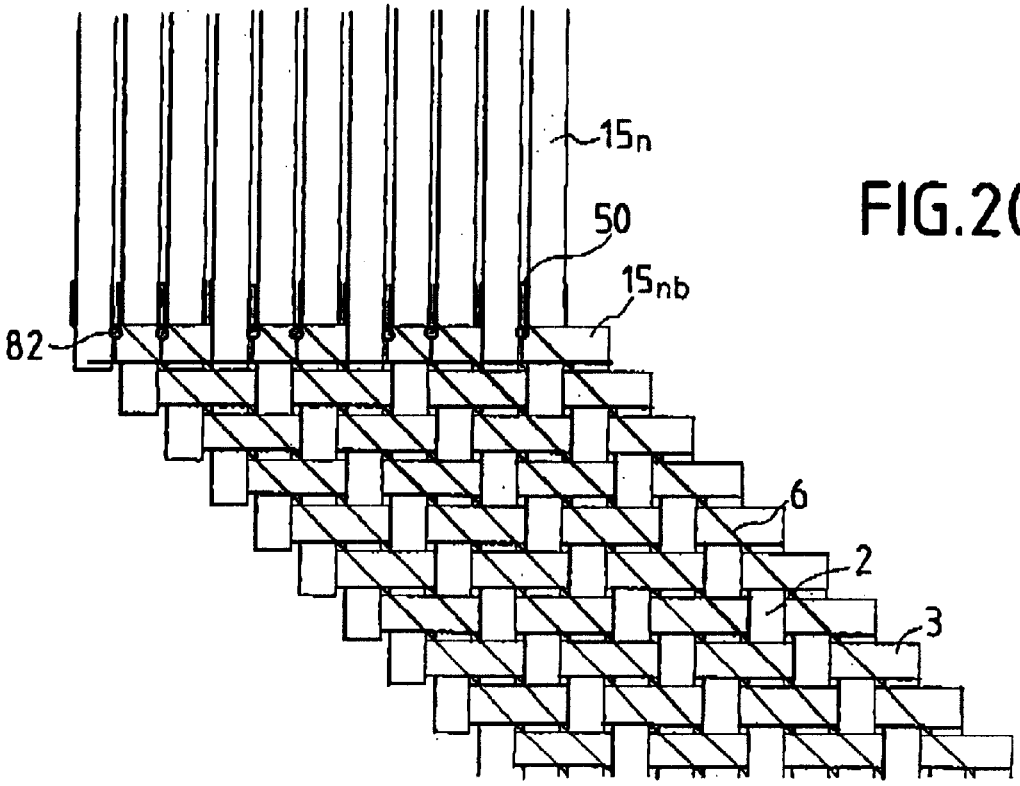

FIGS. 16 and 18 show an example of weaving cloth 1 with a satin weave. FIGS. 19 and 20 shown an example of weaving in accordance with the invention while adopting a 2/1 serge weave, with the eyelets 82 being positioned during insertion of the yarn segment $\mathbf{15}_{nb}$ (FIG. 19) and during beating of said segment (FIG. 20).

INDUSTRIAL APPLICATION

A preferred application of the invention lies in producing engineering fabrics at ±45° for producing shaped parts from a matrix of synthetic material in which said fabric is embedded to constitute reinforcement.

The invention is not limited to the examples described and shown, and various modifications can be applied thereto without going beyond its ambit.

What is claimed is:

1. A method of manufacturing bias fabric in the form of a cloth (1) of finite width and of indefinite length, the method being characterized in that it consists in:

warping a sheet of yarns (15) parallel to a direction (x–x') by causing them to be taken in charge by first and second transfer means (11, 12) occupying mutually parallel directions (y–y') at an angle (α) with the direction (x–x');

progressively building up said sheet by placing the yarns successively along a sheet set-up edge (10');

moving said yarns by the first and second transfer means through one step in the oblique transverse direction from the set-up edge towards an opposite take-up edge (10");

causing a set-up yarn ($\mathbf{15}_n$) occupying the opposite take-up edge (10") additionally to be taken in charge by a third transfer means (13) situated at a distance from and parallel to the first transfer means in order to act substantially on a middle portion of said yarn;

opening the sheet to form two half-sheets so as to define a shed (16) close to the first and the third transfer means;

cutting the set-up yarn ($\mathbf{15}_n$) brought substantially over the take-up edge substantially in the middle portion thereof;

leaving in place that portion ($\mathbf{15}_{na}$) of said yarn ($\mathbf{15}_n$) that is held by an inlet of the third transfer means and by an outlet of the first transfer means to constitute a yarn (2) of the future cloth;

taking the segment ($\mathbf{15}_{nb}$) of said yarn that is situated between the third and the second transfer means and inserting it into the shed along a direction (z–z') perpendicular to the direction (x–x') from the take-up edge towards the set-up edge so as to constitute a yarn (3) of the cloth; and proceeding in the same manner in succession with each yarn brought to the take-up edge while also placing a new yarn along the set-up edge and progressively building up an interlace of yarn segments taken in charge by the first and third transfer means and progressing along the direction (y–y') that is oblique relative to the direction (x–x').

2. A method according to claim 1, characterized by beating each segment of yarn ($\mathbf{15}_{nb}$) inserted successively into the shed.

3. A method according to claim 1, characterized in that each yarn ($\mathbf{15}_n$) of the sheet is set up by using the first and the second transfer means simultaneously to take a unit length of yarn for being taken in charge from a feed reel (14).

4. A method according to claim 1, characterized in that each yarn of the sheet is set up from the yarn (3) unwound continuously from the feed reel by means of a zigzag picking carriage co-operating with retaining needles or pine presented by the first and second transfer means, and then cutting the yarn (3) when brought to the take-up edge (10") at the outlet from the second transfer means and upstream from the third means.

5. A method according to claim 1, characterized in that each yarn ($\mathbf{15}_n$) of the sheet is taken in charge throughout its transfer in the transverse direction from the set-up edge (10') to the take-up edge (10") by a set of combs (50) performing the functions of guiding the yarns laterally, of opening and closing half-sheets in a selected weave, and of beating each yarn segment inserted into the shed (16).

6. A method according to claim 1, characterized in that the second transfer means (12) is placed on a moving support for compensating the apparent reduction in yarn length when the shed is opened.

7. A method according to claim 1, characterized in that at least one straight reinforcing yarn (6) extending parallel to the length (L) of the cloth is inserted between the yarns of the sheet and the inserted yarn segments.

8. A method according to claim 7, characterized:

in that the reinforcing yarn (6) is inserted by a yarn-guide eyelet (82) placed substantially over the opening of the shed, between the combs (50) and the insertion direction of each yarn segment; and in that said reinforcing yarn (6) is temporarily held in position between each insertion of a yarn segment, substantially in the vicinity of the most recently inserted segment, by a removable alignment needle (83).

9. A method according to claim 8, characterized in that the alignment needle is offset laterally relative to the yarn-guide eyelet by a distance equal to the width of the yarn ($15_n$).

10. A method according to claim 1, characterized in that when the yarns constituting the sheet are of the flat type, the method further comprising the step of implementing a mechanism (70) for turning over and bending the yarn without twisting after the yarn brought to the take-up edge has been cut.

11. A method according to claim 1, further comprising the step of binding at least one selvage of the cloth taken in charge by the first and third handling and transfer means.

12. A loom for continuously manufacturing a bias fabric, the fabric being in the form of a cloth (1) of finite width (l) and of indefinite length (L), the loom being characterized in that it comprises:

a section (21) for warping a sheet of yarns ($15_n$) that are set up in succession parallel to one another from a sheet set-up edge (10');

first and second handling and transverse transfer means (11, 12) extending obliquely relative to said yarns towards a take-up edge (10") of the sheet, said means extending parallel to each other along a direction (α) that is oblique relative to the direction (x–x') of the yarns, said oblique direction defining the direction (y–y') in which the cloth is produced;

third means (13) set up at a distance from and parallel to the second means and driven in the same direction as the first two means so as to take in charge a substantially middle portion of the yarn ($15_n$) of the sheet that occupies the take-up edge;

a section (45) for opening and closing the sheet to form two half-sheets so as to define a shed (16) upstream from the first and second handling means in the cloth production direction;

means (17–18) serving firstly to cut the yarn ($15_n$) of the sheet that occupies the take-up edge at a point upstream from the third handling means, and secondly to leave a portion ($15_{na}$) of yarn for constituting one of the yarns (2) of the cloth in place between the first and third handling means, while also taking hold of the segment of yarn ($15_{nb}$) extending between the cut and the second handling means and inserting it into the open shed; and means (50) for beating each inserted yarn segment ($15_{nb}$) and causing it to be taken in charge by the first and third means which guide the resulting bias fabric.

13. A bias loom according to claim 12, characterized in that the warping section comprises, in association with the set-up edge (10'), a placing device (40) for successively placing yarns ($15_n$) tensioned between inlet ends of the first and second handling and transfer means.

14. A bias loom according to claim 13, characterized in that the placing device (40) is constituted by gripping means (41) for unwinding a unit length of yarn from a reel (14), for setting it up between the inlet sections of the first and second handling means, and in that the device is associated with a member suitable for cutting off said unit length.

15. A bias loom according to claim 13, characterized in that the placing device (40) is constituted by a zigzag picking carriage unwinding a yarn from a reel and passing it around pins or needles presented by the first and second handling and transfer means, and in that it then comprises an additional cutting member ($17_a$) situated at an outlet from the second transfer means (12).

16. A bias loom according to claim 12, characterized in that the handling and transfer means are constituted by endless belts that are driven to move synchronously.

17. A bias loom according to claim 12 or claim 16, characterized in that the handling and transfer means are provided with means for temporarily securing the yarns.

18. A bias loom according to any one of claims 12 and 17, characterized in that the handling and transfer means lie in a direction that is at 45° relative to the direction of the yarns of the sheet.

19. A bias loom according to any one of claims 12 to 18, characterized in that the first and/or third handling means are associated with means (33) for binding at least one of the selvages of the cloth.

20. A bias loom according to claim 12, characterized in that the opening and closing section comprises a system of combs (50) taking charge individually of the yarns ($15_n$) of the sheet by providing them with lateral guidance, stepwise transfer, and relative spacing selected as a function of the selected weave so as to define the insertion shed and the beating of the inserted yarn segment.

21. A bias loom according to claim 20, characterized in that the comb system (50) comprises, for each yarn of the sheet, an elastically deformable blade (52) associated with a selectively controlled pusher (56) forming a bracket (51) for guiding the yarn laterally, for transferring the yarn laterally, and for beating the inserted yarn segment.

22. A bias loom according to claim 12, characterized in that the means for cutting the yarn ($15_n$) occupying the take-up edge (10") and for inserting it into the shed (16) comprise a member (17) for cutting said yarn, a member (18) for taking hold of the segment of yarn ($15_{nb}$) extending between the cut and the second handling means (12) and a member (61) for inserting said segment into the shed from the take-up edge towards the set-up edge (10').

23. A bias loom according to claim 22, characterized in that the insertion member is a rod.

24. A bias loom according to claim 22, characterized in that the holding member is a rod that is pivotally mounted and capable of taking hold of the cut-off segment of yarn, parallel to its length, and for causing it to be moved in a common plane through 90° so as to face the open shed and so as to insert it into said shed.

25. A bias loom according to any one of claim 22, characterized in that the means for cutting and inserting the yarn segment are associated with a turn-over finger (70) performing an orienting function.

26. A bias loom according to claim 25, characterized in that the turn-over finger (70) comprises a cylindrical bar (71) associated with a tongue (72) with which it defines a notch for passing the yarn ($15_n$) that occupies the take-up edge (10"), said bar being oriented at 45° relative to the direction of said yarn.

27. A bias loom according to claim 26, characterized in that the bar is mounted so as to be capable of pivoting about its axis.

28. A bias loom according to claim 12, characterized in that it includes a device for inserting at least one straight reinforcing yarn (6) extending parallel to the length of the cloth and held captive between the yarns of the sheet and the inserted yarn segments.

29. A bias loom according to claim 28, characterized in that the insertion device comprises a yarn-guide eyelet (82) disposed substantially over the section for opening and closing the sheet.

30. A bias loom according to claim 28, characterized in that the insertion device comprises, on a removable alignment needle (83) disposed substantially over the last-inserted yarn segment and offset by one segment width from the eyelet.

* * * * *